United States Patent [19]

Rosseau

[11] Patent Number: 4,555,824

[45] Date of Patent: Dec. 3, 1985

[54] DEBRIS COLLECTION SYSTEM FOR STREET SWEEPERS

[75] Inventor: Richard B. Rosseau, Claremont, Calif.

[73] Assignee: FMC Corporation, Chicago, Ill.

[21] Appl. No.: 615,659

[22] Filed: May 31, 1984

Related U.S. Application Data

[62] Division of Ser. No. 431,959, Sep. 30, 1982.

[51] Int. Cl.[4] ..... E01H 1/04

[52] U.S. Cl. ..... 15/87; 15/83

[58] Field of Search ..... 15/53 B, 82, 83, 84, 15/85, 86, 87, 340, 385, DIG. 2, 53 R; 277/212 FB; 308/3 A, 3 B, 3 R, 3.5, 4 R, 6 B, DIG. 11; 92/130 C, 130 D

[56] References Cited

U.S. PATENT DOCUMENTS

| | | | |
|---|---|---|---|
| 1,407,180 | 2/1922 | Todd | 15/87 |
| 2,462,659 | 2/1949 | Molotzak | 308/5 R |
| 2,996,742 | 8/1961 | Aimers | 15/87 |
| 3,439,372 | 4/1969 | Collier | 15/53 R |
| 4,197,652 | 4/1980 | Qurnell | 308/4 |

*Primary Examiner*—Edward L. Roberts

*Attorney, Agent, or Firm*—H. M. Stanley; R. B. Megley

[57] ABSTRACT

A street sweeper has floating support apparatus for supporting both a pick-up broom and a pair of laterally and forwardly disposed gutter brushes beneath a sweeper framework and for providing controlled broom and brush pressures on the surface being swept. A ball bushing and vertical shaft provides gutter brush suspension and spherical bearings and support arms provide pick-up broom suspension. The gutter brushes and pick-up broom are directly driven by hydraulic motors mounted on their respective suspension structures. Debris is directed inwardly on the swept surface by the gutter brushes toward the path of the pick-up broom. Laterally disposed dirt shoes lie adjacent the ends of the pick-up broom to prevent debris from flowing around the ends of the broom, whereby debris is further guided inwardly toward the pick-up broom for propulsion toward an elevator for transfer into a framework mounted debris hopper.

3 Claims, 14 Drawing Figures

UP
DN
T
P

FIG_9
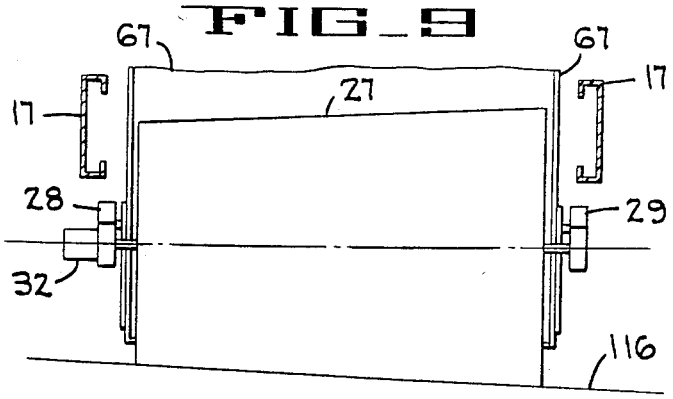
FIG_10
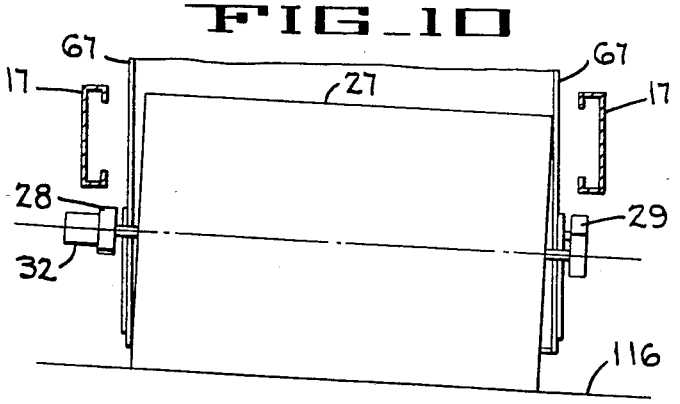
FIG_6
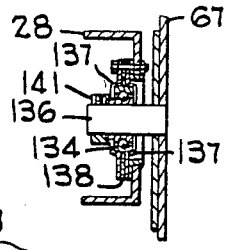
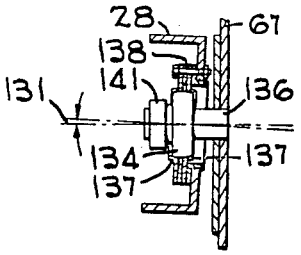
FIG_7
FIG_8
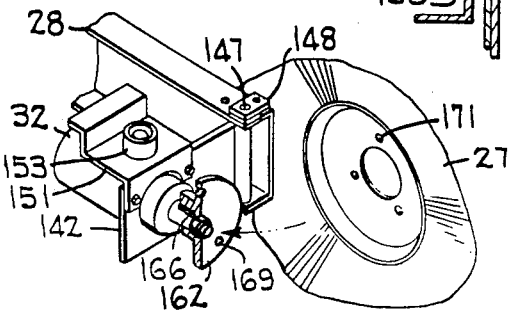

FIG_11
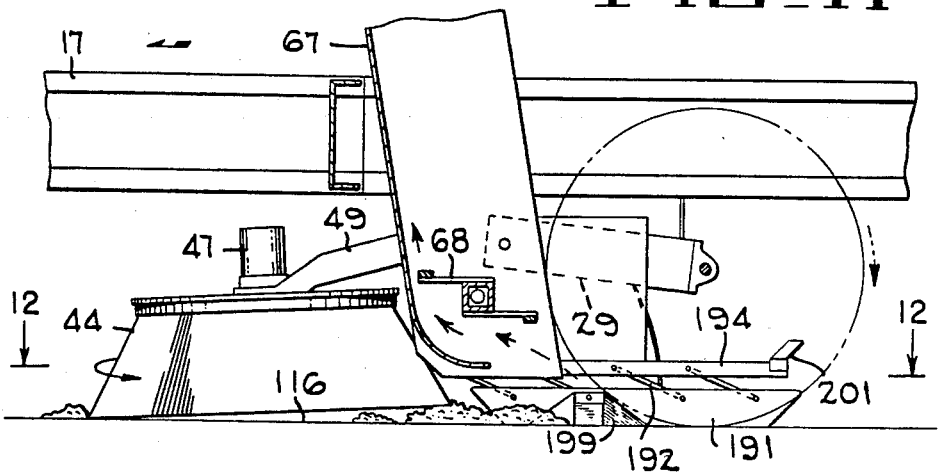
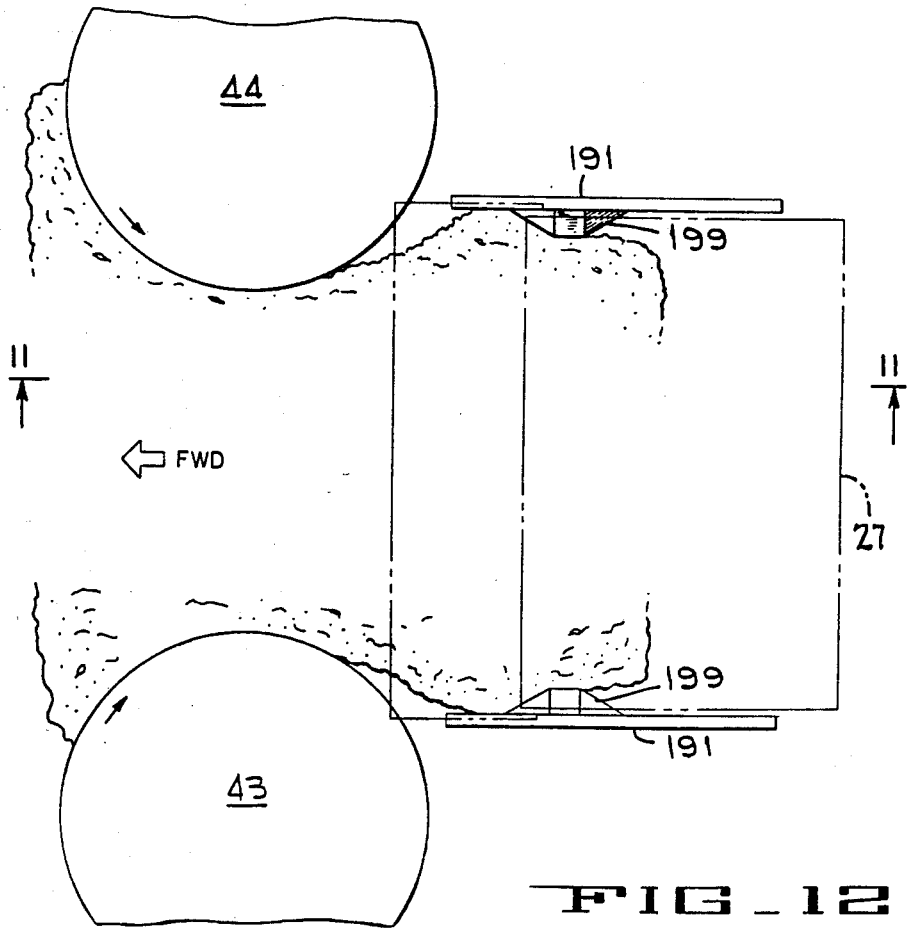
FIG_12

FIG_13
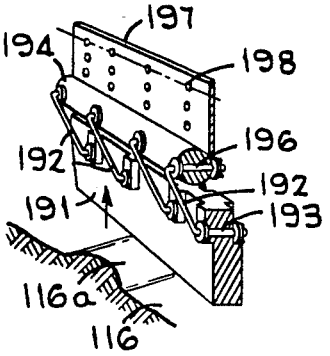
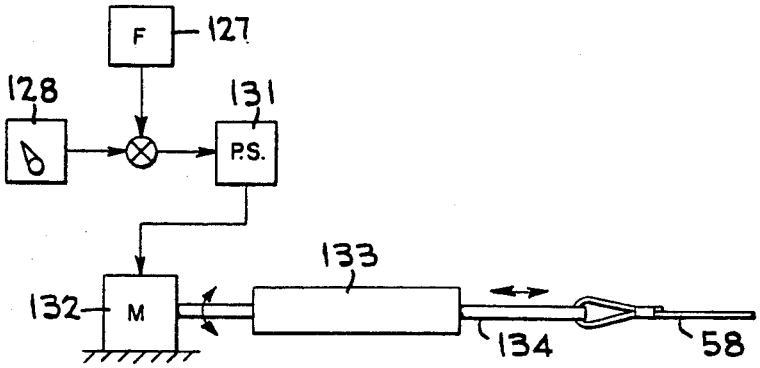
FIG_14

DEBRIS COLLECTION SYSTEM FOR STREET SWEEPERS

This application is a division of application Ser. No. 431,959, filed Sept. 30, 1982.

CROSS REFERENCE TO RELATED APPLICATIONS

The present invention is related to the inventions disclosed in the following applications, all filed on even date herewith and presently assigned to the Assignee of the present invention:

Erdman et al. Application Ser. No. 431,948, filed Sept. 30, 1982, now U.S. Pat. No. 4,457,044, entitled Multiple Flight Elevator System.

Kassai application Ser. No. 431,947, filed Sept. 30, 1982, entitled Sweeper With Hydraulically Driven Components.

Gunnarsson application Ser. No. 431,949, filed Sept. 30, 1982, entitled Hopper Support And Dump Mechanism.

The disclosures of the above identified applications are incorporated by reference herein.

BACKGROUND OF THE INVENTION

1. Field of the Invention

The present invention relates to street sweepers and more particularly relates to such street sweepers having suspended driven gutter brushes and pick-up brooms.

2. Description of the Prior Art

Pick-up broom and gutter brush suspension mechanisms are evidenced by U.S. Pat. No. 3,363,274 issued to Tamny on Jan. 16, 1968, U.S. Pat. No. 3,584,326, issued to Woodworth on June 15, 1971, U.S. Pat. No. 3,316,578, issued to Tamny on May 2, 1967 and U.S. Pat. No. 3,825,968 issued to Larsen on July 30, 1974. These references show spring supports for sweeping brooms and brushes as well as hydraulic actuators for lifting sweeping assemblies from an underlying surface to be swept.

SUMMARY OF THE INVENTION

A street sweeping machine has a framework and a floating support apparatus for a driven sweeping brush, wherein the brush is adapted for contact with an underlying surface to be swept. Means is provided for suspending the driven sweeping brush from the machine framework and for allowing up and down movement of the sweeping brush relative to the framework. Further means is fixed to the framework for providing infinitely variable positioning of an adjustable member extending therefrom within a range between fully extended and fully retracted positions of the adjustable member. A spring assembly is coupled at one end to the adjustable member and means is provided for coupling the other end of the spring assembly to the means for suspending. Means for controlling the means providing infinitely variable positioning is provided so that the means for suspending is moved between a raised carrying position and various lowered brushing positions. Consequently, brush pressure on the underlying surface to be swept is adjustable.

In accordance with another aspect of the invention a street sweeping machine is disclosed which has a framework and a pick-up broom and which carries a pick-up broom suspension. Left and right longitudinally extending broom support arms are provided together with means for attaching the broom support arms at one end to the framework and for providing three dimensional angular movement of the arms relative to the framework. Means is present for attaching the other end of each of the broom support arms to opposing ends of the pick-up broom, the means for attaching providing for a single degree of angular movement between one of the broom support arms and the respective broom end. A motor is mounted on the means for attaching on the one broom support arm and is coupled to the pick-up broom to drive the broom rotationally.

In accordance with yet another aspect of the invention a gutter brush suspension is disposed in a street sweeping machine having a framework and a gutter brush. A substantially vertically disposed rod is mounted in fixed vertical position on the framework and a brush arm having a bore therethrough near one end and means for mounting the gutter brush at the other end is provided. Means for mounting the gutter brush is provided at the other end of the brush arm. The motor is also mounted on the other end of the brush arm and is coupled to directly drive the gutter brush rotationally. A ball bushing assembly is disposed surrounding the rod and within the bore, whereby the suspension may move upwardly and downwardly relative to the framework.

In accordance with still another aspect of the invention a debris guidance system is disclosed in a street sweeping machine having a framework and an elevator operating to propel debris into a debris container within the framework. A cylindrical pick-up broom is suspended from the framework and is disposed in contact with an underlying surface to be swept. Means is provided for directly driving the pick-up broom rotationally to sweep the underlying surface. A dirt shoe is disposed in contact with the surface adjacent to each end of the cylindrical pick-up broom and extending forwardly therefrom. A plurality of rigid parallel dirt shoe support arms are pivotally attached to a lower portion of the framework at one end and to the dirt shoe at the other. In accordance with this structure the dirt shoe resists yawing motion during sweeping machine turns, prevents debris from passing around the ends of the pick-up broom, and maintains dirt shoe parallelism with the lower portion of the framework as the dirt shoe is moved upwardly and downwardly by irregularities on the surface to be swept.

BRIEF DESCRIPTION OF THE DRAWINGS

FIG. 6 is a section taken through one part of the pick-up broom suspension of the present invention.

FIG. 7 is a section similar to FIG. 6.

FIG. 8 is a detail perspective view of one portion of the pick-up broom suspension.

FIG. 9 is a partial section through the street sweeper looking forward from behind the pick-up broom.

FIG. 10 is a partial section similar to FIG. 9.

FIG. 11 is a partial section taken along the line 11—11 of FIG. 12.

FIG. 12 is a partial section taken along the line 12—12 of FIG. 11.

FIG. 13 is a detail perspective view of the dirt shoe of the present invention.

FIG. 14 is an alternate embodiment of the control for the floating support apparatus of the present invention.

DESCRIPTION OF THE PREFERRED EMBODIMENTS

Figure 1:
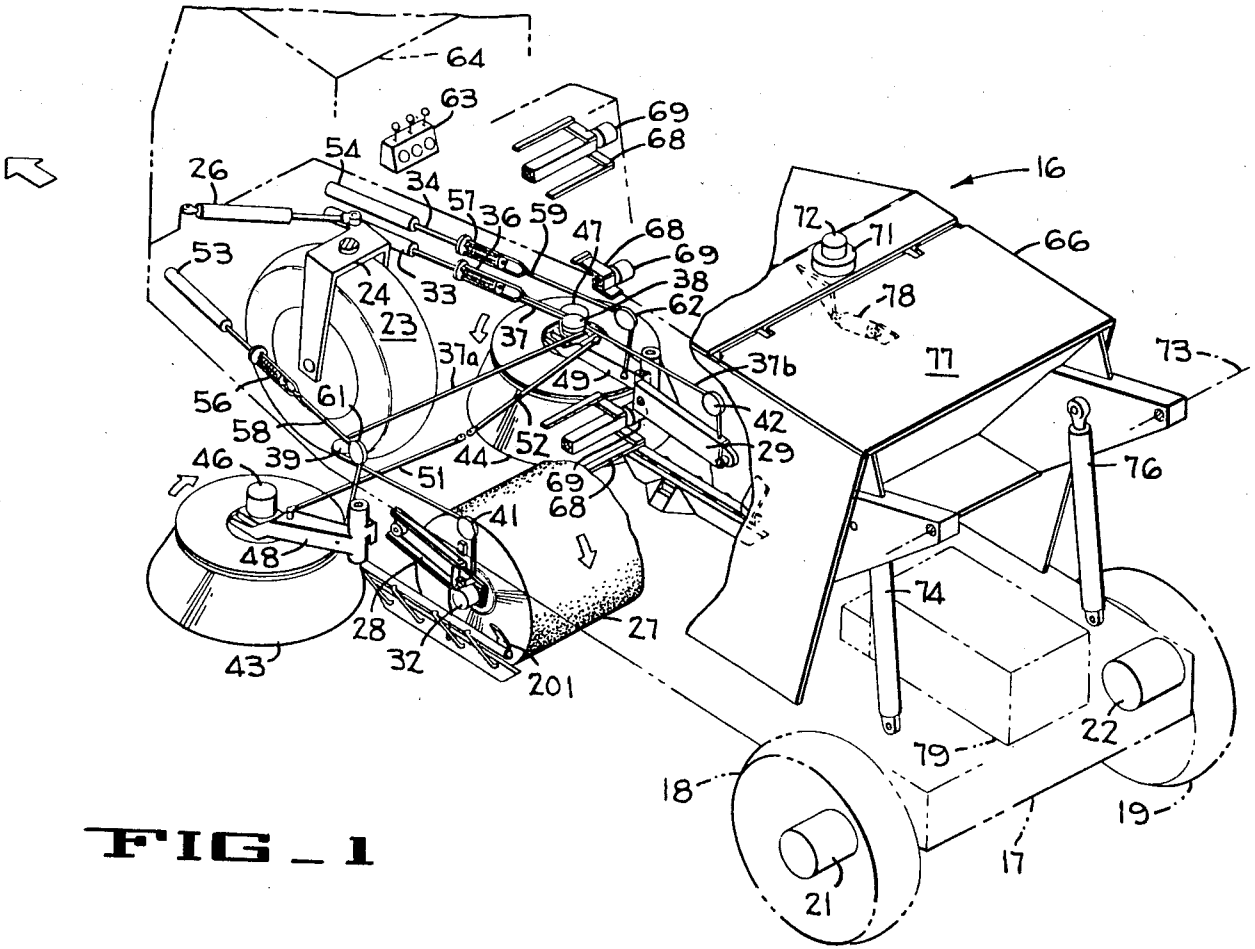
FIG. 1 is a diagrammatic perspective view with parts in phantom line and other parts broken away illustrating a mobile street sweeper which incorporates the present invention.

A street sweeper shown generally at 16 in FIG. 1 includes a chassis or framework 17 supported by a pair of rear wheels 18 and 19 driven individually by hydraulic motors 21 and 22 respectively. A single steerable front wheel 23 is journaled on a yoke 24 which pivotally supports the front of the chassis 17 and is steered by a hydraulic cylinder 26 connected between the chassis and the yoke.

A debris pick-up broom 27 is rotatably mounted on a pair of longitudinally extending broom support arms 28 and 29 (FIGS. 1 and 5) which have their forward ends pivotally supported on the framework 17 for movement about a horizontal pivot axis 31. The pick-up broom is directly driven by a hydraulic motor 32 and is moved between an elevated transport position and a lowered sweeping position by a hydraulic cylinder 33. The hydraulic cylinder has a piston contained therein with an adjustable member or rod 34 extending therefrom which is coupled to a spring assembly 36. A dual cable 37 is attached to the other end of the spring assembly and is directed over dual sheaves 38 toward the free ends of the broom support arms 28 and 29. One reach **37*a* of the dual cable successively passes around sheaves 39 and 41 to the free end of the brush support arm 28. Another reach 37*b* of the dual cable passes around a sheath 42 to the free end of the brush support arm 29. The aforementioned sheaves are journaled to the framework 17**.

The sweeper 16 also includes left and right gutter brushes 43 and 44 driven by individual hydraulic motors 46 and 47. The gutter brushes and hydraulic motor are mounted on left and right gutter brush suspension arms 48 and 49 which are in turn mounted for vertical movement relative to the framework 17 by suspension means to be hereinafter described. Cables 51 and 52 are connected between the framework 17 and the associated arms 48 and 49 respectively to limit the outward lateral movement of the gutter brushes.

The gutter brushes are each moved between a raised transport position and a lowered road engaging gutter sweeping position by hydraulic cylinders 53 and 54. One end of each of the hydraulic cylinders 53 and 54 is connected to the chassis 17 and the other end is connected to an associated spring assembly 56 and 57 which is similar to the spring assembly 36 aforementioned. Cables 58 and 59 are attached to and extend from the spring assemblies 56 and 57 respectively over sheaves 61 and 62 and are fastened at the other end to the left and right gutter brush arms 48 and 49. An operator actuated control console 63 is provided in a cab portion 64 of the street sweeper 16 for controlling the movement of the hydraulic cylinders 33, 53 and 54 to thereby control the movement of the associated pick-up broom and gutter brushes between their respective transport positions and positions in engagement with the underlying surface to be swept and also to obtain selected sweeping pressures by means to be hereinafter described. When the gutter brushes 43 and 44 are raised to the transport position, the brooms are mounted so as to move inwardly toward the centerline of the chassis 17.

Figure 5:
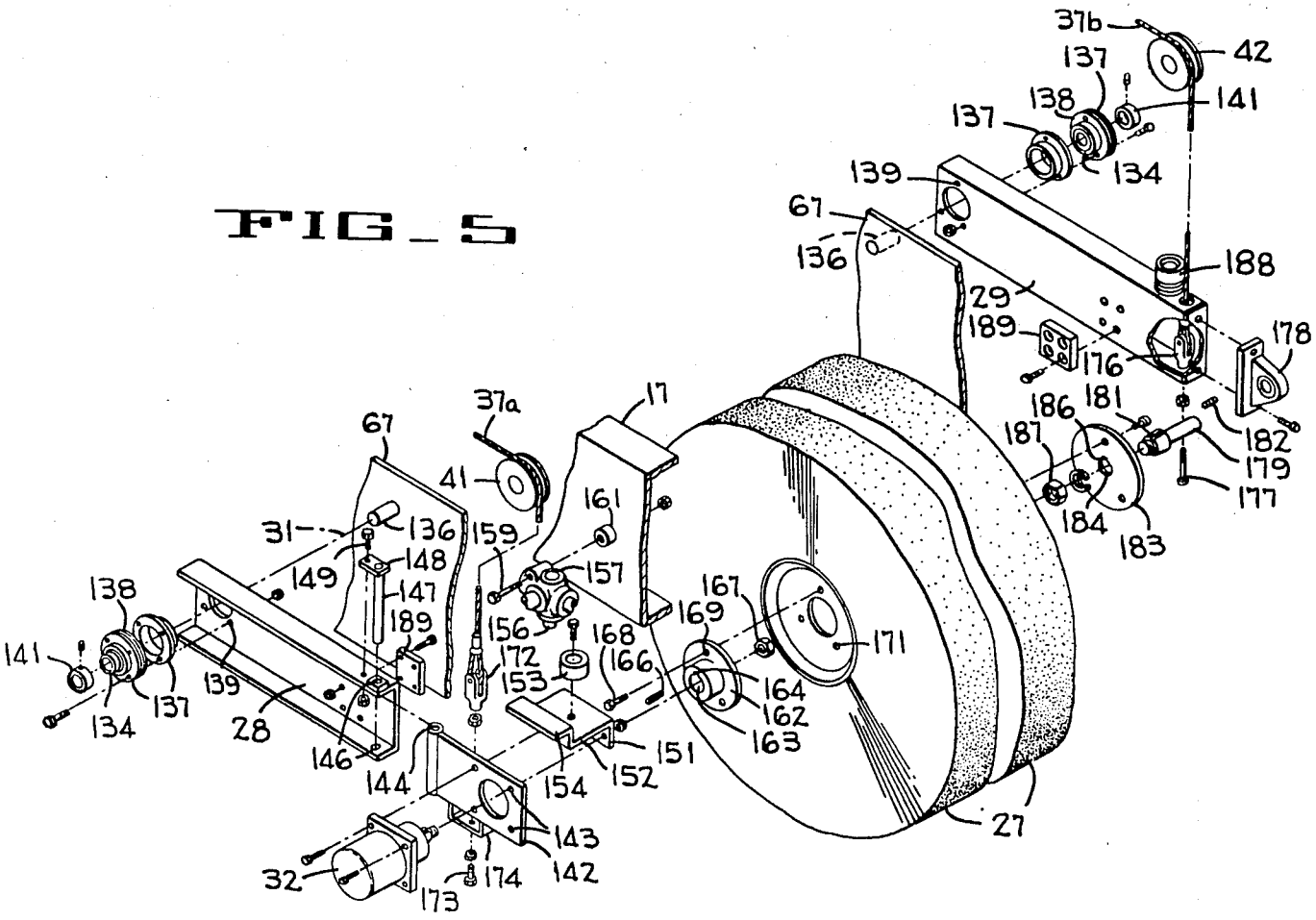
FIG. 5 is an exploded perspective view of the pick-up broom suspension apparatus of the present invention.

The debris directed into the path of the pick-up broom 27 by the gutter brushes 43 and 44 is swept forwardly by the pick-up broom and transported to a hopper 66 by means of an elevator having a housing 67 (shown partially in FIG. 5). The elevator includes a plurality of paddle wheels 68 (parts of three such paddels being illustrated in FIG. 1) which are each independently driven by a hydraulic motor 69 for progressively elevating the debris within the elevator and discharging it into the hopper 66. A low volume air blower 71 is driven by a hydraulic motor 72 and is mounted on top of the hopper for creating an updraft of air through the elevator 67 thereby aiding the movement of leaves or the like through the elevator and into the hopper 66.

The hopper 66 is supported on the chassis 17 for pivotal movement about an axis 73 between the illustrated debris receiving position and a debris dumping position. A pair of hydraulic cylinders 74 and 76 are pivotally connected between the chassis 17 and the hopper 66 to pivot the hopper between the two positions. The hopper includes a gate 77 which is pivotally attached to the hopper. A gate opening hydraulic cylinder 78 is connected between the hopper structure and the gate 77 for pivoting the gate between an open position and the illustrated closed position.

The sweeper 16 includes an engine 79 which drives a hydraulic pump (not shown) which provides hydraulic pressure for the various hydraulically actuated components on the street sweeper. The engine also provides electrical power through conventional means for components in the street sweeper which require electrical energy for actuation.

Figures 2, 3:
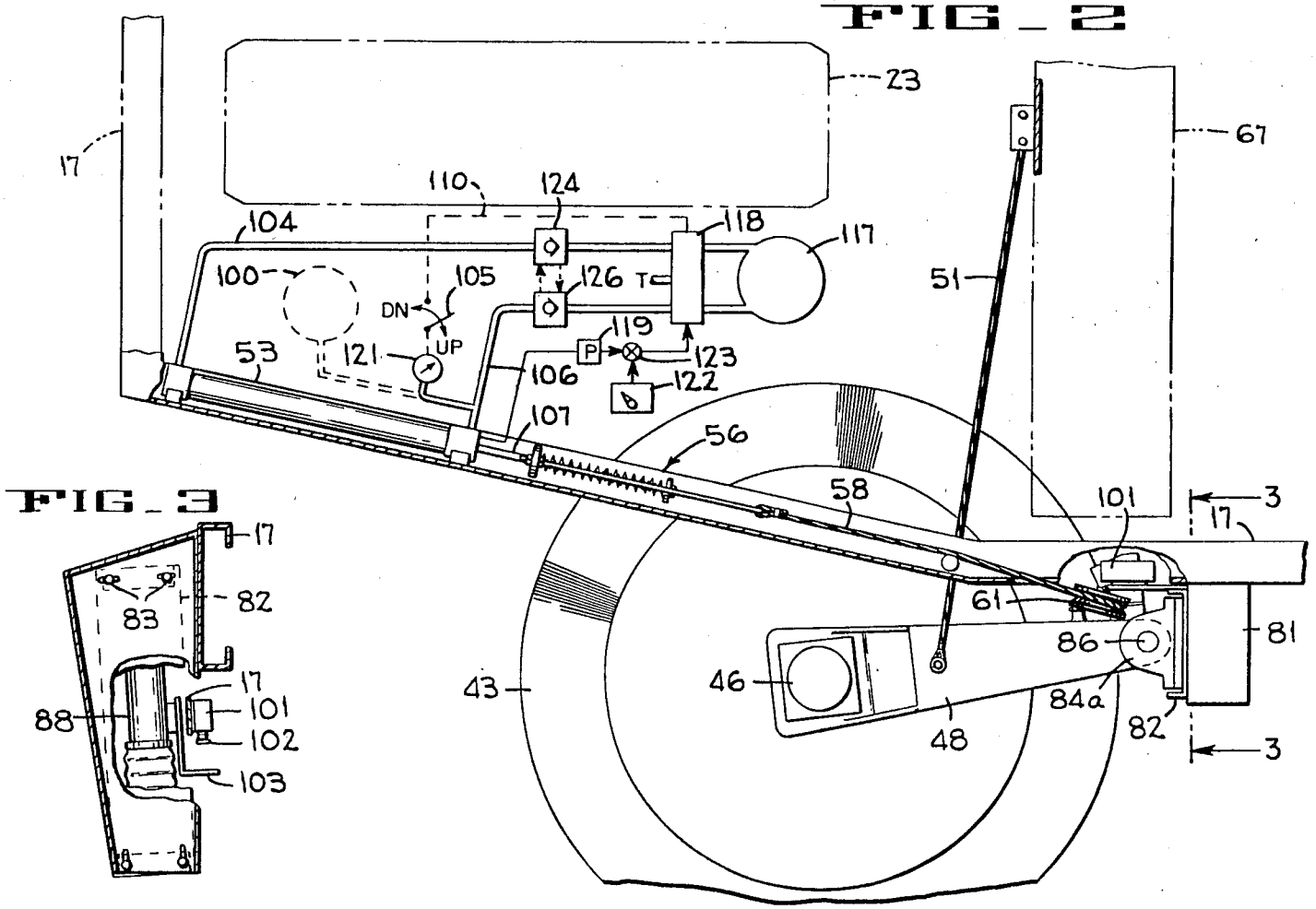
FIG. 2 is a partial plan view showing one embodiment of the floating support apparatus of the present invention.
FIG. 3 is a partial section taken along the line 3—3 of FIG. 2.
Figure 4:
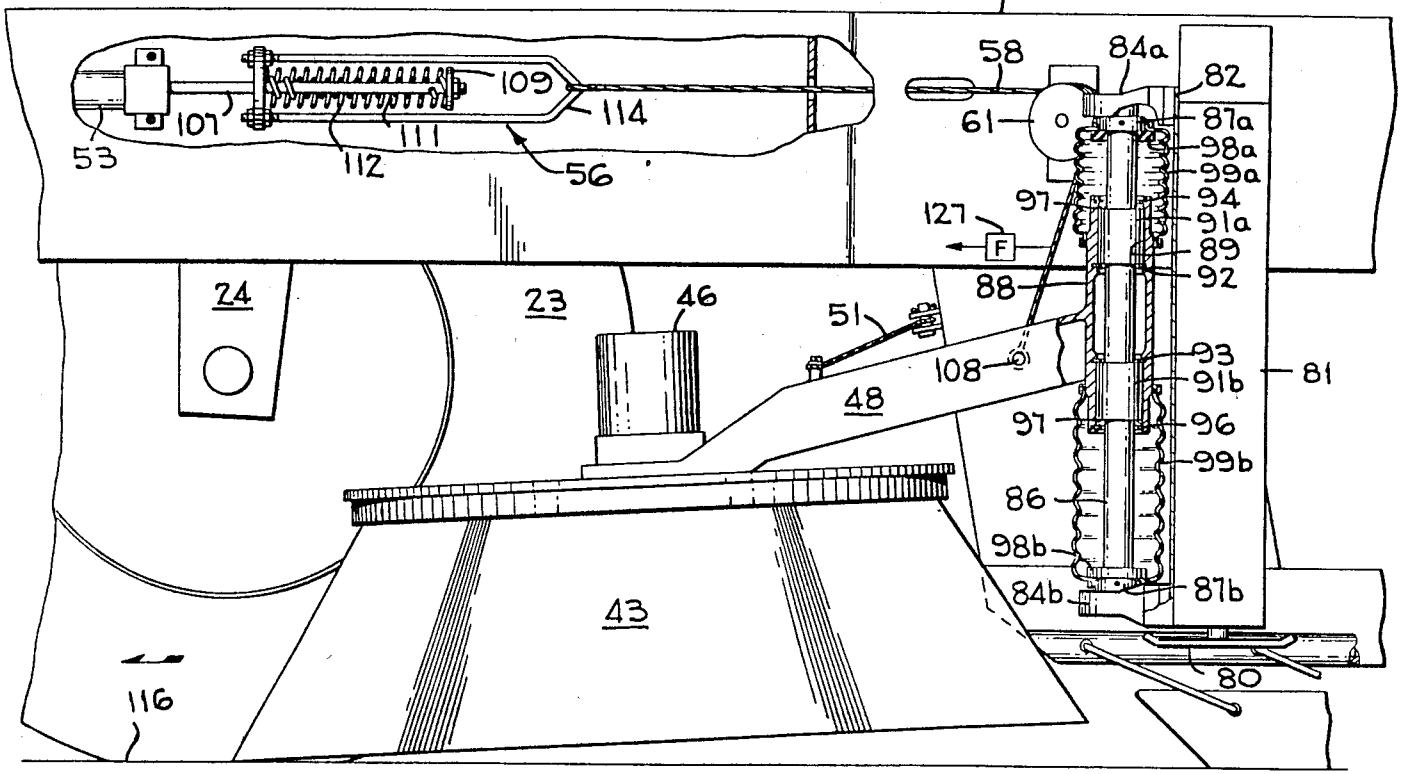
FIG. 4 is a partial side elevation view showing the gutter brush support and suspension mechanisms of the present invention.

With reference now to FIGS. 2, 3 and 4 a detailed description of the floating support apparatus for a driven sweeping brush will be undertaken. The sweeping brush may be one of the gutter brushes 43 or 44 or it may be the pick-up broom 27, since all three of the floating support assemblies for these sweeping brushes are substantially the same. The manner in which the gutter brushes and the pick-up broom are suspended beneath the framework 17 is somewhat different however. As seen in FIGS. 2 through 4 a box-like member 81 is secured to the framework 17 by any appropriate means such as bolts or by welding. A jack pad or skid 80 is attached to the underside of the box-like member to bring the frame mounted structure into contact with the underlying surface before the sweeper center of gravity migrates outside its base of support. One such skid or jack pad 80 is provided on each side of the vehicle in the position indicated. A pillow block channel 82 is secured to the forward face of the box-like member by means of bolts 83 which pass through holes in the box-like member. The holes, as seen in FIG. 3, may be elongated to provide for some positioning of the channel on the box-like member. An upper pillow block bearing **84*a* and a lower pillow block bearing 84*b* are secured within the pillow block channel by means of the same bolts 83 which secure the channel to the box-like member. A rod or shaft 86 is engaged at each end by the pillow block bearings and is therefore fixed in relationship to the framework 17. An upper and a lower lock collar 87*a* and 87*b* are secured by set screws to the shaft adjacent each of the pillow block bearings to retain the shaft axially. A left gutter brush arm 48 (which is a mirror image of the right gutter brush arm 49) has a boss 88 at one end thereof with a bore 89 therethrough. The bore is shaped to receive an upper ball bushing 91***a* and a lower ball bushing 91*b*. The bore 89 is also shaped to receive snap rings 92 and 93 adjacent the inner ends of the ball bushings and snap rings 94 and 96 adjacent the outer ends of the ball bushings. Disposed between the snap ring 94 and the ball bushing 91*a* and the snap ring 96 and the ball bushing 91*b* is a wiper and wiper retainer set 97 which serve to preclude entry of dirt into the ball bushings. An upper resilient bumper 98*a* and a lower resilient bumper 98*b* are disposed adjacent the upper and lower lock collars respectively to absorb the impact of the boss 88 at the upper and lower limits of linear travel of the gutter brush arm on the shaft 86. An upper axially expandable bellows 99*a* and a lower axially expandable bellows 99*b* are secured at one end to the lock collars and at the opposite end to the periphery of the boss 88 to thereby block dirt from accumulating on the otherwise exposed portions of the shaft 86. The left gutter brush arm 48 may be seen to be capable of substantially vertical motion relative to the framework 17. The right gutter brush arm 49 is capable of the same motion by means of the same suspension structure just described.

It may be seen by reference to FIGS. 2 and 3 that a hydraulic valve 101 is attached to a portion of the framework 17 and has a spring loaded actuating button 102 depending therefrom. The valve is disposed in a hydraulic line (not shown) which provides hydraulic pressure to the hydraulic drive motor 46 for the gutter brush 43. A bracket 103 is attached to the side of the box 88 on the gutter brush arm 48 so that when the gutter brush arm is in a raised transport position the bracket depresses the spring loaded button 102 and shuts off hydraulic pressure to the gutter brush drive motor 46. In this fashion the gutter brush is prevented from being driven when in the upward transport position. The same structure exists for preventing driving of the right gutter brush 44.

Referring once again to FIGS. 2 and 4 it should be noted that the hydraulic cylinder 53 is fixed to the framework 17 and has hydraulic lines 104 and 106 extending from opposite ends thereof. The cylinder 53 has a piston (not shown) disposed therein which may be moved axially within the cylinder by appropriate introduction of pressure into one end or the other of the cylinder through the lines 104 and 106. A positionally adjustable member, such as the illustrated piston rod 107, is attached to the piston and extends through one end of the cylinder. The free end of the rod has attached thereto the spring assembly 56 which is engaged by the cable 58 leading over the sheath 51 and secured at a point of attachment 108 to the gutter brush arm 48 as hereinbefore described.

The spring assembly 56 is shown in detail in FIG. 4, wherein a fixed spring stop 109 is attached to the end of the rod 107 and a shorter stronger spring 111 (200 pounds per inch for example) is disposed surrounding the rod and adjacent to the fixed spring stop. A longer weaker spring 112 (30 pounds per inch) is also disposed surrounding the rod 107 as well as the shorter spring and has one end adjacent to the fixed spring stop 109. A sliding spring stop 113 surrounds the rod 107 operating to capature the two aforementioned springs on the rod in cooperation with the fixed spring stop 109. A yoke 114 is fixed at the open end thereof to the sliding spring stop and is engaged by a bight at the end of the cable 58 at the other end thereof. As may be seen when a portion of the load provided by the gutter brush 43 and arm 48 is supported by an underlying surface 116 to be swept, the longer weaker compression spring 112 absorbs the force in the cable 58. However, when the gutter brush apparatus is in a raised transport position, the longer weaker spring will be totally compressed and the shorter stronger spring 111 will assist in holding the gutter brush in the raised position together with the cable 58. All of the spring assemblies 36 and 57 are substantially the same as spring assembly 56 just described.

As shown in FIG. 2 a source of hydraulic pressure 117 is connected to a hydraulic selector valve 118 which will either admit hydraulic pressure into line 104 or 106 or remove hydraulic pressure from both lines. The hydraulic valve may be electrically or hydraulically actuated thereby being responsive to either electrical or hydraulic signals. A pressure sensor 119 is coupled to the brush support end of the hydraulic cylinder 53 from which the hydraulic line 106 extends. Thus, the pressure sensor will provide a pressure signal indication which is proportional to the tension force in the cable 58 and thereby an indication which is in inverse relationship with the contact force between the gutter brush 43 and the underlying surface to be swept 116. A pressure meter 121 is provided in communication with the brush support end of the cylinder 53. The meter may be calibrated to read in terms of the contact force between the gutter brush and the underlying surface.

A proportional control for brush pressure on the underlying surface is shown in FIG. 2 and includes a manually accessible control signal generator 122 which generates a control or brush pressure signal in reponse to manual settings. The sensed pressure signal from the pressure sensor 119 and the control signal are summed at a summing point 123 and the summation is connected to the hydraulic selector valve 118 for appropriate actuation thereof to bring the pressure at the brush support end of the cylinder 53 to the selected level.

When the valve 118 is response to a signal from the summing point 123 provides pressure to a selected one of the lines 104 or 106, a pair of pilot operated check valves 124 and 126 operate to pass the pressure through the selected line and to allow hydraulic fluid to escape from the other end of the cylinder through the nonselected line to a tank or reservoir indicated by the letter T in FIG. 2. The pilot operated check valves function to pass fluid when pressure is directed to the pressure supply side of the valve and to then control the valve in the other hydraulic line to unseat and allow flow through the other line to the reservoir T. For example, if the selector valve 118 receives a signal which calls for an increase in brush pressure with the underlying surface 116, the piston rod 107 will be moved to extend further from the cylinder 53 by introducing pressure to the pressure side of the check valve 124 and therethrough into the left end of cylinder 53 as seen in FIG. 2. Concurrently, the check valve 124 provides a hydraulic signal, as indicated by dashed lines, to the check valve 126 which unseats the valve and allows passage of fluid therethrough which is routed through the selector valve 118 into the reservoir or tank T. A manually set signal requiring lesser brush pressure places pressure to the pressure side of the check valve 126 causing flow therethrough and unseating of the check valve 124 to allow flow therethrough to the tank. This causes the rod 107 to retract within the cylinder 53 and tension to increase within the cable 58, whereby pressure between the gutter brush and the underlying surface is decreased.

The spring assemblies 36, 56 and 57 may be replaced by an accumulator 100 in communication with the end of the cylinders 33, 53 and 54 to which hydraulic line 106 is attached (the "lift end"). The accumulator is a completely enclosed container, about one gallon in volume in this embodiment, with air at atmospheric pressure trapped therein. The accumulator thus provides a compressible fluid in communication with the "lift end" of the cylinder which acts as a "spring". When the sweeping brushes are controlled to the lowered sweeping position by operator actuation of the appropriate controls 63 (FIG. 1), a signal path 110 from an adjustable selector associated with meter 121 is closed, as represented in FIG. 2 by closure of switch 105. The adjustable selection designates a low pressure limit, and therefore a high brush contact pressure limit with the swept surface. When the pressure in the "lift end" of the cylinder reaches the preselected level, a signal is transmitted through switch 105 over path 110 to the selector valve 118 which shuts hydraulic pressure off to line 104 and blocks line 106 at check valve 126. The piston in the cylinder may therefore move only by compressing the gas in the accumulator, which provides a spring rate of about eight pounds per inch. This low spring rate allows vertical movement of the sweeping brushes over swept surface irregularities with minimal change in the brush contact pressure. When the sweeping brushes are controlled to the raised transport position, the signal path 110 is opened by switch 105 so that sufficient pressure may be obtained with the "lift end" of the cylinders to raise and to maintain the brushes in the raised position.

It should be noted from the foregoing that with the proportional control of FIG. 2 the piston rod 107 and therefore the pressure between the sweeping brush and the swept surface is infinitely variable within the range of brush pressures available. The limit control, shown in dashed lines in FIG. 2, on the other hand provides only a preset sweeping brush pressure. Moreover, it should be noted that the structure for proportionally controlling the variation of sweeping pressure may take more than one form as shown with reference to FIG. 14 of the drawings. In this alternate control configuration a force transducer or load cell 127 (also seen in FIG. 4) is coupled to the cable 58 to obtain a signal indicative of the tension in the cable. Another manually accessible control signal generator 128 is provided to input signals to the system for controlling the brush sweeping pressure. The signals from the force transducer 127 and the selector 128 are summed at a summing point 129 and the summation signal is delivered to a power supply 131. The power supply provides an output in accordance with the summation which is coupled to a motor 132. The motor is connected to drive a ball screw 133 which in turn has an adjustable member or rod 134 extending therefrom. The cable 58 is coupled to the end of the rod and the entire control functions as hereinbefore described for the hydraulic control system of FIG. 2. It should be noted that the control structure of FIG. 14 may also be coupled to support cable 59 or dual support cable 37 to control the sweeping pressure of the gutter brush 44 or the pick-up broom 27 respectively.

With reference now to FIGS. 5, 6 and 7 of the drawings, the suspension mechanism for the pick-up broom 27 will be described. As mentioned hereinbefore the longitudinally extending pick-up broom support arms 28 and 29 are pivotally attached at their forward ends to the framework 17, or more specifically pivotally attached to the side walls of the elevator 67 which is in turn mounted on the framework. The pivotal mounting for each support arm is identical and will be described in conjunction with support arm 28. An extended inner ring ball bearing 134 with a spherical outside diameter (standard type WG216U from Link Belt) is mounted on a stub shaft 136 extending from the side wall of the elevator 67. A pair of opposing cups 137 having an annular spacer 138 therebetween are disposed about the periphery of the spherical outside diameter, wherein the spacer provides for a sliding fit between the bearing outside diameter and the inner surfaces of the cups. Matching hole patterns in the cups and spacer are aligned with a hole pattern 139 adjacent to the pivoted end of the brush support arm 28. With the bearing and cup assembly attached by means of bolts passing through the holes in the pattern 139 to the end of the support arm, the support arm and bearing assembly is mounted on the stub shaft 136. The bearing is retained on the stub shaft by means of a lock collar and set screw 141 which is fixed to the free end of the stub shaft. The mounted broom support arm may be seen to be attached for pivotal movement relative to the framework about the stub shaft axis 31 as well as for limited angular movement about the longitudinal and lateral axes of the support arm due to the spherical nature of the outside diameter on the ball bearing 134.

The free ends of the support arms 28 and 29 are not configured alike. Support arm 28 has a motor mounting plate 142 having a set of bolt holes 143 therethrough which match a set of mounting holes contained in the flange on the hydraulic motor 32. The motor is therefore mounted on the plate my means of bolts and nuts as seen in FIG. 5. One side of the motor mounting plate has a passage 144 extending therethrough which is configured to be aligned with holes 146 in the upper and lower flanges of the support arm 28. A pin 147 is configured to pass through the holes 146 and the passage 144 to pivotally retain the motor plate on the support arm, whereby it may move angularly relative to the support arm about the axis of the pin 147. The pin is retained in position by means of an end mounted flange plate 148 and a bolt 149 passing through the flange plate and the upper flange of the support arm. The bolt is engaged at the opposite end by a nut as shown.

A valve actuating bracket 151 is secured to the motor mounting plate 142 as seen in FIG. 5 by means of the bolts and nuts which secure the motor 32 to the mounting plate. A first plateau 152 on the valve actuating bracket is used to mount a resilient bumper 153 which may contact the underside of the framework 17 when the pick-up broom 27 is in an upward transport position. A second plateau 154 on the valve actuating bracket contacts a shutoff push button 156 on a valve 157 disposed within the hydraulic line which provides hydraulic pressure to the pick-up broom drive motor 32. The push button is spring loaded to the open position and is only actuated to remove the drive pressure from the motor 32 when the pick-up broom is in the raised transport position. The valve is fastened in place on the framework 17 by means of a bolt and nut combination 159 which passes through a hole in the valve body and another hole in the framework. A spacer 161 is shown between the framework and the valve body for appropriate positioning of the push button 156 relative to the second plateau 154 on the valve actuating bracket.

As shown in FIG. 8, hydraulic motor 32 when mounted on the motor mounting plate 142 together with the valve actuation bracket 151 may be swung outwardly around the axis of the pin 147 away from the adjacent end of the pick-up broom 27. The manner in which a broom drive or end casting 162 is coupled to the output shaft of the hydraulic motor 32 is shown in both FIGS. 5 and 8. The end casting has a centrally disposed bore 163 therethrough with a keyway 164 formed in the bore. A key 166 is formed to fit within the keyway 164 as well as within a keyway formed on the motor output shaft. Insertion of the key 166 into the keyway in the motor shaft and subsequent insertion of the shaft and key through the bore 163 engages the shaft and end casting through contact with the keyway 164. A nut 167 is fastened to a threaded end on the motor shaft thereafter to retain the end casting axially on the shaft. The end casting is thereafter attached to the end of the pickup broom by means of screws 168 which pass through a set of holes 169 in the end casting and into a matching set of threaded holes 171 in the end of the broom. In this fashion the broom may be seen to be driven directly by the motor 32. Also, it may be seen that side loads on the motor shaft are relieved by the capability for pivotal motion about the longitudinal axis of the pin 147.

A clevis member 172 is attached by means of a bolt 173 and associated nuts to a bracket 174. The bracket 174 is in turn attached to the motor mounting plate 142. A bight in the free end of the support cable **37*a* is engaged by the clevis member to thereby couple the free end of the broom support arm 28 to the floating support apparatus for the pick-up broom 27 as hereinbefore described. The free end of the broom support arm 29 is supported by a clevis member 176 located within the free end of the support arm and attached thereto by a bolt 177 and associated nuts and washers. The clevis member 176 engages a bight in the end of the cable 37*b* to thereby attach the support arm 29 to the floating support assembly for the pick-up broom as also hereinbefore described. The free end of the support arm 29 has a pillow block bearing 178 fastened thereto by means of screws as shown. The bearing 178 accepts a stub shaft 179 therethrough. The stub shaft has a keyway 181 therein which is formed to accept a key 182. Another broom end casting 183 has a hole 184 therethrough with a keyway 186 formed at one side of the hole. The stub shaft 179 has a threaded end which accepts a retaining nut 187. When the key 182 is placed within the keyway 181 and the stub shaft threaded end is inserted through the hole 184, the key engages the keyway 186 locking the stub shaft and end casting 183 rotationally. The stub shaft is retaining axially within the end casting by means of the nut 187 which engages the threaded end of the shaft 179. The end casting is fastened to the end of the pick-up broom 27 adjacent to the broom support arm 29 in the same fashion as hereinbefore described for end casting 162**.

A resilient bumper 188 is mounted toward the free end of the support arm 29 to absorb impact forces between the end of the support arm and the framework 17 when the pick-up broom suspension is raised upwardly by underlying irregularities on the surface to be swept or by lifting the pick-up broom to the upward transport position by means of the floating support apparatus for the pick-up broom. It should also be noted that pads 189, of some material such as brake lining material, are fastened to the inside surfaces of the support arms 28 and 29 to act as snubbers between the support arms and the adjacent walls of the elevator 67.

The manner in which the broom support arms 28 and 29 are free to move angularly with respect to the elevator 67 and the framework 17 about the longitudinal and lateral axes of the support arms is best explained with reference to FIGS. 6 and 7. In FIG. 6 the support arm 28 is shown aligned with its vertical surface more or less parallel with the elevator side plate 67, whereas in FIG. 7 it is shown rotated slightly about the longitudinal axis of the support arm as the cups 137 are rotated slightly on the spherical outside surface of the ball bearing 134. The necessity for allowance of this type of motion between the broom support arms and the framework is best described with reference to FIGS. 9 and 10. Since the street sweeper 16 has only a single steerable front wheel 24, and the pick-up broom 27 is mounted forwardly on the vehicle, the broom may be inclined laterally by the underlying surface 116 without the frame being so inclined by the same surface because the frame has only a single wheel contact forward. In the invention disclosed herein, the pick-up broom 27 will contact the entire underlying surface to be swept with equal pressure on the surface thereacross under these conditions as shown in FIG. 10. Without the pick-up broom suspension features disclosed herein, the pick-up broom would be forced to assume the attitude shown in FIG. 9. This would cause the broom either to wear in a manner to eventually assume the shape of a frustum of a cone or to provide high broom pressure against the underlying surface at one side of the broom and allow the broom to actually clear the underlying surface at the other side.

With reference now to FIGS. 11, 12 and 13, it may be seen that the left and right gutter brushes 43 and 44 rotate in such a direction as to throw debris inwardly toward a path in front of the pick-up broom 27. Debris which is either initially in the path of the pick-up broom or is thrown there by the aforementioned action of the gutter brushes is eventually contacted by the pick-up broom and cast forwardly from the line of contact between the pick-up broom and the surface into the elevator 67 by the rotation of the broom indicated by the arrows in FIG. 11. The driven paddles 68 and the minimal air flow provided by blower 71 transport the debris through the elevator to the hopper 66 as described in the aforementioned Erdman et al. application. The gutter brushes are seen in FIG. 11 to be disposed by their respective brush arms 48 and 49 to assume a three or four degree leading edge down attitude, so that debris at the trailing edge of the gutter brushes has a lesser tendency to be cast outwardly. There may be some tendency for outward casting of debris by the gutter brushes nonetheless. To minimize the tendency for debris to be cast outwardly by the trailing edges of the gutter brushes or to flow outwardly around the outer ends of the pick-up broom, the debris guidance system disclosed herein includes a dirt shoe 191 disposed adjacent to each end of the pick-up broom and extending forwardly from the lateral position of the broom. The dirt shoes are fabricated of a flexible material and are suspended on a plurality of rigid U-shaped support arms 192 which are pivotally attached to the dirt shoe. One branch of each of the U-shaped arms passes through a plurality of holes 193 formed in the dirt shoes as best seen in FIG. 13. The upper branches of the U-shaped arms are pivotally attached to a solid dirt shoe support bar 194 having holes 196 therethrough to receive the upper branches of the arms 192. The ends of the "U" shaped arms may be retained in the holes 193 and 196 by means such as cotter keys. The support bar is fastened to a height adjusting plate 197 having a plurality of horizontally disposed hole patterns 198 so that the support bar may be adjustably mounted in height at the lower edge of the side plate on the elevator 67. The dirt shoe is thereby lifted upwardly by a bump on the underlying surface such as seen at 116*a* in FIG. 13. The dirt shoe thereby maintains its parallelism with the dirt shoe support bar 194 and holds its position adjacent to the edge of the pick-up broom 27. In this fashion the lower edge of the dirt shoe 191 experiences a uniform wear along the entire length of the shoe edge contacting the underlying surface. Moreover, when the street sweeper 16 is steered into a turn, the dirt shoe will not wobble or yaw relative to the chassis or framework 17 which assists in retaining the debris in the path of the pick-up broom.

A deflector member 199 is attached to the inner surface of each of the dirt shoes 191 as best seen in FIGS. 11 and 12. The somewhat triangular shaped deflector has a sloping forwardly facing surface thereon which deflects debris inwardly from the dirt shoe toward the path of the pick-up broom 27 to thereby prevent or minimize passage of debris between the ends of the pick-up broom and the dirt shoes. A bristle deflector 201 is mounted near the after end of each of the dirt shoe support bars 194. The bristle deflector is inclined slightly outwardly from the end of the pick-up broom. Consequently, the descending end bristles on the pick-up brooms which may tend to become splayed outwardly are guided inwardly as they pass the support bar to prevent entanglement with the rigid U-shaped arms 192 between the support bar and the dirt shoe.

Although the best mode contemplated for carrying out the present invention has been herein shown and described, it will be apparent that modification and variation may be made without departing from what is regarded to be the subject matter of the invention.

What is claimed is:

1. In a street sweeping machine having a framework, a floating support apparatus for a driven sweeping brush adapted for contact with an underlying surface to be swept, wherein said sweeping brush is a gutter brush, comprising a substantially vertical shaft attached to the framework, a brush arm adapted to carry a driven gutter brush, said arm having a bore therethrough at one end for receiving said substantially vertical shaft, a set of ball bushings disposed within said bore and configured to engage said shaft, whereby the brush arm may move up and down thereon, means for providing infinitely variable positioning of an adjustable member extending from the framework within a range between fully extended and fully retracted positions of said adjustable member, a spring means coupled at one end to said adjustable member, means for coupling the other end of said spring means to said brush arm, and means for controlling said means providing infinitely variable positioning so that said brush arm is moved between a raised carrying position and various lowered brushing positions, whereby gutter brush pressure on the underlying surface to be swept is adjustable.

2. In a street sweeping machine having a framework and a gutter brush, a gutter brush suspension comprising a substantially vertically disposed rod mounted in fixed vertical position on the framework, a brush arm having a bore therethrough near one end, means for mounting the gutter brush at the other end of said brush arm, a motor mounted on said other end of said brush arm coupled to drive the gutter brush rotationally, a ball bushing assembly disposed surrounding said rod and within said bore, whereby the gutter brush may move upwardly and downwardly relative to the framework, a positionally adjustable member attached to and extending from the framework, spring means for coupling said adjustable member to said brush arm, means for providing a signal indicative of contact pressure between said gutter brush and an underlying surface to be swept, and means for adjusting the position of said positionally adjustable member to thereby obtain a predetermined contact pressure between said brush and said surface by urging the gutter brush upwardly and downwardly in response to said contact pressure signal.

3. In a street sweeping machine, a gutter brush suspension as in claim 2, wherein said ball bushing assembly comprises upper and lower ball bushings surrounding said rod and disposed within said bore, means for retaining said ball bushings axially within said bore, an axially expanding bellows covering exposed portions of said rod, and resilient bumpers disposed between said suspension and the framework at said upward and downward suspension movement limits.

* * * * *